US005296867A

United States Patent [19]

Jaquet

[11] Patent Number: 5,296,867

[45] Date of Patent: Mar. 22, 1994

[54] ELECTRONIC SWITCHING DEVICE FOR AN ANTENNA SWITCHABLE IN THE VHF AND UHF FREQUENCY RANGES

[75] Inventor: Hervé Jaquet, Paris, France

[73] Assignee: Dassault-Aviation, Paris, France

[21] Appl. No.: 894,651

[22] Filed: Jun. 5, 1992

[30] Foreign Application Priority Data

Jun. 6, 1991 [FR] France ..... 91 06860

[51] Int. Cl.[5] ..... H01Q 9/06; H01Q 1/28

[52] U.S. Cl. ..... 343/745; 343/750; 343/895; 343/708

[58] Field of Search ..... 343/745, 750, 895, 708, 343/705, 747, 749, 876, 872; H01Q 9/06, 1/28

[56] References Cited

U.S. PATENT DOCUMENTS

| | | | |
|---|---|---|---|
| 3,852,759 | 12/1974 | Felsenheld et al. | 343/729 |
| 4,502,025 | 2/1985 | Carl, Jr. et al. | 333/24 R |
| 4,656,483 | 4/1987 | Jaquet | 343/745 |
| 4,939,525 | 7/1990 | Brunner | 343/745 |

FOREIGN PATENT DOCUMENTS 2147147 5/1985 United Kingdom .

OTHER PUBLICATIONS

1987 International Symposium Digest Antennas and Propagation vol. I. Jun. 1987, Blacksburg, Va. pp. 422–425; Joesph et al.: 'Applications of Microwave Fiber Optic Links'.

Radio and Electronic Engineer vol. 54, No. 1, Jan. 1984, London GB, pp. 1–9; Davies: 'Opto-electronics-a new dimension in electronics'.

*Primary Examiner*—Donald Hajec

*Assistant Examiner*—Hoanganh Le

*Attorney, Agent, or Firm*—Stevens, Davis, Miller & Mosher

[57] ABSTRACT

A switching device for adjusting the impedance of a self-inductance (3) forming part for example of the radiator of a VHF/UHF antenna for aircraft switchable by short-circuiting a part of the self-inductance. A PIN diode (12) is raised to a blocking or a transmitting voltage in response to control signals which are transmitted thereto by an optical link (8). Preferably the optical signals are transmitted to a hybrid opto-electronic circuit, which renders the PIN diode operative in conjunction with insulated conductors (11, 13) plated on the self-inductance and raised to the desired voltage.

6 Claims, 1 Drawing Sheet

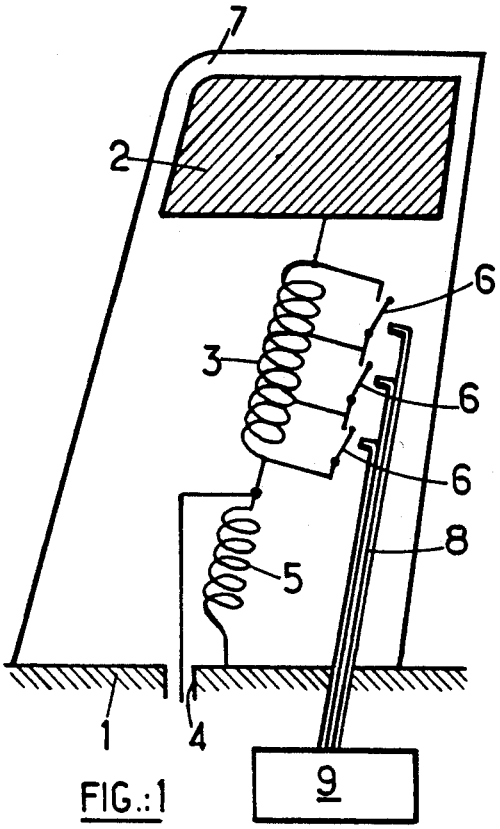
FIG.:1
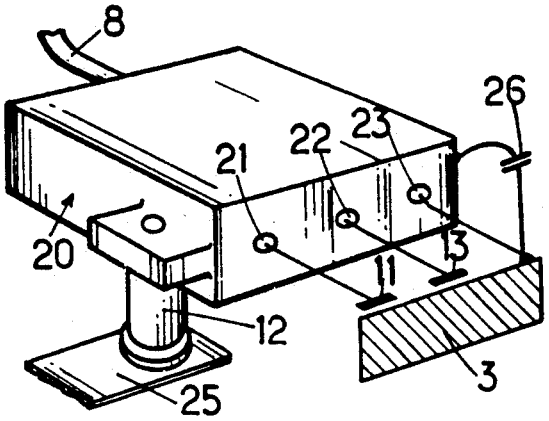
FIG.:3
FIG.:2
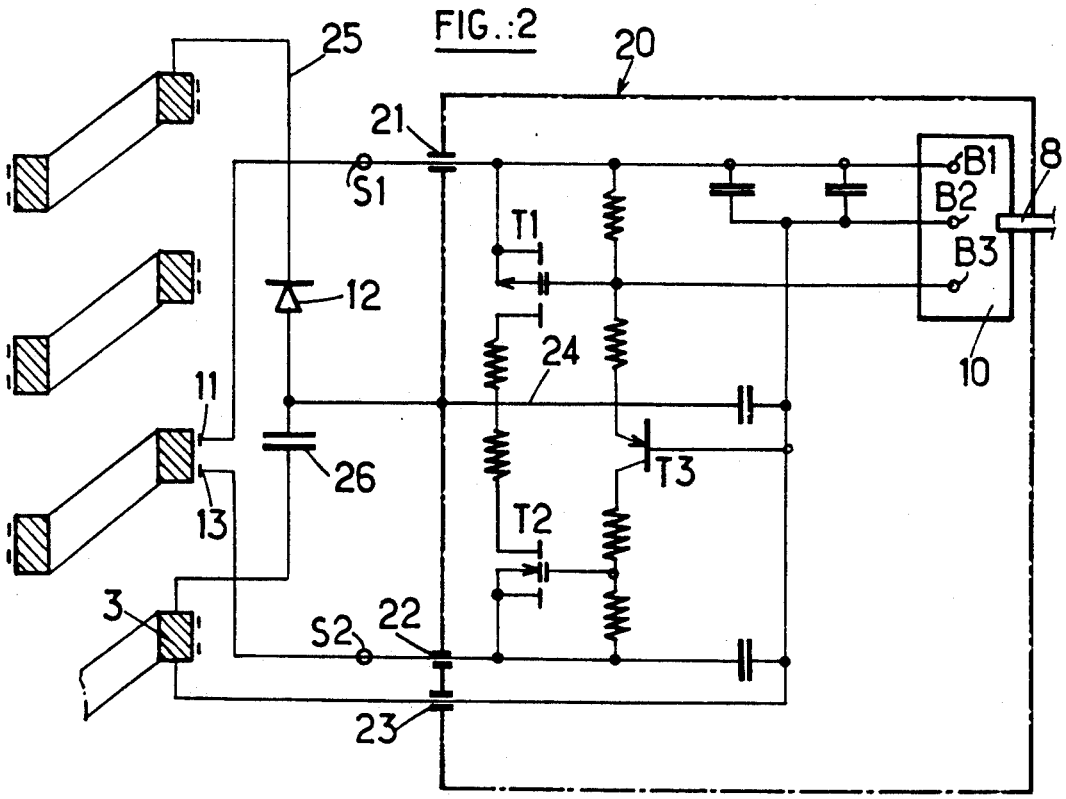

ELECTRONIC SWITCHING DEVICE FOR AN ANTENNA SWITCHABLE IN THE VHF AND UHF FREQUENCY RANGES

BACKGROUND OF THE INVENTION

The present invention relates to an electronic switching device for an antenna switchable in the VHF and UHF frequency ranges, for example 100 to 156 MHz for the VHF range and 225 to 400 MHz for the UHF range.

Such antennas are often, but not exclusively, used on board civil or military aircraft.

In the reference FR-A 2 552 587 (which corresponds to U.S. Pat. No. 4,656,483 in the name of Hervé JAQUET) there is described a switchable antenna which comprises a capacitive element spaced from a flat reflector forming the ground, a first self-inductance located between the capacitive element and a feed through the flat reflector, and connected to a transmitter-receiver, this first self-inductance being formed from several sections, each associated with a switch which enables certain sections to be short-circuited at will for operation in the VHF range and all sections for operation in the UHF range. The antenna described in this reference further comprises a second self-inductance which can be connected by a switch between the first self-inductance and the ground plane in the VHF range and disconnected in the UHF range, as well as conductive sleeves inserted between the capacitive element and the ground plane, on either side of the self-inductances.

The switches associated with the sections of the first self-inductance and with the second self-inductance advantageously comprise PIN diodes. In conventional manner bias voltages for controlling the bias of these diodes are injected by means of conductors which feed through the ground plane and in which high-frequency isolating self-inductances are provided.

This arrangement, as applied to antennas, has several disadvantages:

- perturbations in the response of the antenna due to the proximity of the conductive wire,
- limited frequency bandwidth of the switch, because this is dependent on the impedance of the self-inductance for blocking high-frequency voltages
- inadequate resistance of the self-inductances to large high-frequency over-voltages, if they comprise a ferrite core,
- loss of output caused by the blocking self-inductances,
- risk of introducing radio interference below the surface of the support vehicle of the antenna by way of the conductive bias wires.

In order to limit these problems it is proposed in the document cited at the beginning of this specification to protect the conductors transmitting the bias voltages for the diodes by making them pass coaxially to the inside of conductors of certain parts of the self-inductance, formed by a metal tube wound in a spiral,. This ingenious solution does not completely avoid the recited problems because the protection of these conductors is not complete, in particular between the self-inductance and the passages through the ground plane.

The object of the present invention is to provide a switching device which does not have the above disadvantages or only exhibits them in a greatly reduced manner compared with the prior art.

SUMMARY OF THE INVENTION

To attain this object the invention provides an electronic switching device for use in a switchable antenna operating in the VHF and/or UHF ranges of frequencies and comprising in particular a capacitive element spaced from a flat reflector forming a ground plane, and at least one self-inductance associated with a switch which can be rendered operative or inoperative as a short-circuit, or to disconnect the capacitive element or not, the switching device comprising a PIN diode located on the same side of the ground plane as the self-inductance, the diode modifying the state of the self-inductance in dependence on its bias and being connected to a control means located on the other side of the ground plane, this switching device in particular having the coupling between the PIN diode and the control means through the ground plane effected by way of an optical link.

The fact that the coupling between the PIN diode and the control means through the ground plane is effected by optical means allows the electrical conductors passing though the ground plane and the blocking self-inductances to be dispensed with. The space located on the other side of the ground plane and which is formed for example by the interior of an aircraft, is much better protected against interference and the problems listed above and which result from the effect of the blocking self-inductances on the performance of the enclosure, are eliminated.

It is known that a PIN diode can be controlled directly by optical means.

If the PIN diode is controlled directly by the signal transmitted by the optical link, a construction of extreme simplicity results. However the present state of the art does not allow such diodes to be implemented with suitable working lives and performances under the very severe conditions which prevail in a radome of a modern aircraft.

In consequence it is advantageous to provide, at least in some cases, a hybrid opto-electronic circuit coupled between the optical link and the PIN diode and applying bias voltages to said diode in response to control signals received via said optical link.

The hybrid circuit comprises in substance an optical control switch arranged to control the application of a suitable bias voltage to the PIN diode, preferably via transistors.

These diode bias voltages are preferably transmitted to the hybrid circuit through insulated conductors plated on the surface of the self-inductance.

The hybrid circuit is also preferably placed inside an electrically conductive box electrically connected to one pole of the PIN diode. The PIN diode is advantageously soldered on the box.

The fact that the hybrid circuit is protected by a box gives protection from parasitic effects. This box may be placed a small distance from the self-inductance so that it can be connected to the conductors used to provide the bias voltages through short conductors. This has the following further advantage: when perfecting a switched VHF/UHF antenna it is necessary to shift the positions of the switches along the self-inductances by successive trials. The modifications to adapt the impedance are subject solely to the influence of the movement of the switch and no longer depend on the coupling feedback with the bias connections of the PIN diode. For this reason the time devoted to perfecting a new antenna is very short compared that obtaining with the adjustment of an antenna provided with a conventional electronic switch.

BRIEF DESCRIPTION OF THE DRAWINGS

The invention will now be explained in more detail with the aid of a practical embodiment for aircraft, illustrated in the drawings, in which:

FIG. 1 is a schematic side view of the antenna, reduced to its principal components.

FIG. 2 is a circuit diagram of a switching device according to the invention.

FIG. 3 is a perspective view of the box.

DETAILED DESCRIPTION OF AN EMBODIMENT OF THE INVENTION

In FIG. 1, the reference 1 denotes the ground plane of the antenna, which forms a flat reflector for its radiator and which is implemented by its metal base for example.

Reference 2 denotes a capacitive element, for example a thin copper plate spaced a suitable distance from the flat reflector 1. A first self-inductance denoted 3 is electrically connected between the capacitive element 2 and a feed-through 4 through the ground plane 1 and which may be formed for example by a coaxial cable at the output of a transmitter-receiver adapted to be switched in the VHF range of frequencies, for example from 30 to 88 and 100 to 150 MHz, and in the UHF range of frequencies, in particular from 225 to 400 MHz. Another self-inductance 5 connects the self-inductance 3 to the ground plane 1.

The self-inductance 3 is formed from several sections, which can be short-circuited independently of each other by means of switches 6 which are actually the subject of the invention.

The reference 7 denotes a radome which surrounds and protects the antenna.

Reference 8 denotes a bundle of optical fibers which pass through the ground plane and send control signals to the switch 6. Below the ground plane a control means 9 emits light signals which are transmitted by the fibers 8.

The switch according to the invention comprises in essence a PIN diode 12 connected to the two ends of the section of the self-inductance which is to be short-circuited. The circuit which will now be described with reference to FIG. 2 is adapted to apply either a conducting voltage, for example +5 volts, or a blocking voltage, for example −250 volts, to the terminals of the PIN diode.

Reference 10 denotes an optical receiver, for example of type HFBR-2201 of the HEWLETT PACKARD Company, connected to an optical fiber 8 and whose three terminals B1, B2, B3 are used. The terminal B1 is connected directly to a first voltage source S1, here held at +5 volts, through a first insulated conductor 11, plated on the self-inductance 3, while the terminal B2 is connected to ground, i.e. to the self-inductance 3.

The third terminal B3 is connected directly to the base of a first transistor T1 of P channel DMOS type, adapted to connect the source of the voltage S1 to the PIN diode 12. The third terminal is also connected to the base of a second transistor T2 of N channel DMOS type, adapted to connect the other source of a voltage S2, here held at −265 volts, by way of a second insulated conductor 13, plated on the self-inductance 3, to the PIN diode 12. This is of type DH 438.08 of the THOMSON Company. It would be possible to use other PIN diodes or two PIN diodes in parallel. Suitable resistors and a PNP transistor are connected in each case between the terminal B3 and the second transistor T2.

It will be understood that, depending on the received optical signal, the PIN diode is raised either to the conducting voltage, here +5 volts, or to the blocking voltage, here −265 volts.

The assembly of the hybrid circuit is placed inside a closed metallic box 20, which only has openings to the outside through passages 21, 22, 23 for the conductors connecting the circuit to the sources of the first and second voltages S1 and S2 and to ground, as well as a passage for the optical cable 8. The control voltage for the PIN diode 12 is fed by way of one or the other of the transistors T1, T2 via a conductor 24 soldered to the interior of the box 20, the PIN diode being soldered to the exterior of the same box (see FIG. 3). There thus results an excellent protection of the circuit against any external effects.

In FIG. 3, the reference 25 denotes the conductor which serves to short-circuit a part of the self-inductance and 25A denotes the conductor which serves to short-circuit the immediately adjacent part of the same self-inductance. A capacitor connected between the self-inductance 3 and the box 20 is denoted 26.

We claim:

1. An electronic switching device for use in a switchable antenna operating in the VHF and/or UHF ranges of frequencies and comprising in particular a capacitive element spaced from a flat reflector forming a ground plane, and at least one self-inductance and a switching device connected between one end of said self-inductance and a point chosen from between another end of said self-inductance and one end of said capacitive element, the switching device comprising a PIN diode located on the same side of the ground plane as the self-inductance, the diode modifying the state of the self-inductance in dependence on its bias and being connected to a control means located on the other side of the ground plane, the coupling between the PIN diode and the control means through the ground plane being effected by way of a link comprising optical transmission means for transmitting an optical signal.

2. The device of claim 1, wherein the PIN diode is controlled directly by the signals transmitted by the link.

3. The device of claim 1, wherein a hybrid opto-electronic circuit is coupled between the link and the PIN diode and applies bias voltages to said diode in response to control signals received via said link.

4. The device of claim 3, wherein the bias voltages of the PIN diode are transmitted to the hybrid circuit by means of insulated conductors plated on the surface of the self-inductance.

5. The device of claim 3, in which the hybrid circuit is disposed inside an electrically conductive box connected electrically to one pole of the PIN diode.

6. The device of claim 5, in which the PIN diode is soldered to the box.

* * * * *